US011236524B2

(12) United States Patent
Murphy et al.

(10) Patent No.: US 11,236,524 B2
(45) **Date of Patent: *Feb. 1, 2022**

(54) DOOR LOCK CHASSIS ASSEMBLY

(71) Applicant: Schlage Lock Company LLC, Carmel, IN (US)

(72) Inventors: Nathanael S. Murphy, Colorado Springs, CO (US); Peter Malenkovic, Monument, CO (US)

(73) Assignee: Schlage Lock Company LLC, Carmel, IN (US)

( * ) Notice: Subject to any disclaimer, the term of this patent is extended or adjusted under 35 U.S.C. 154(b) by 134 days.

This patent is subject to a terminal disclaimer.

(21) Appl. No.: 16/717,654

(22) Filed: Dec. 17, 2019

(65) Prior Publication Data

US 2020/0232251 A1 Jul. 23, 2020

Related U.S. Application Data

(63) Continuation of application No. 15/466,230, filed on Mar. 22, 2017, now Pat. No. 10,508,468.

(Continued)

(51) Int. Cl.
*E05B 3/04* (2006.01)
*E05B 55/00* (2006.01)

(Continued)

(52) U.S. Cl.
CPC ..... *E05B 3/04* (2013.01); *E05B 1/003* (2013.01); *E05B 3/003* (2013.01); *E05B 15/0033* (2013.01); *E05B 15/16* (2013.01); *E05B 55/005* (2013.01); *E05B 63/0056* (2013.01); *E05B 3/065* (2013.01); *E05B 9/02* (2013.01); *E05B 17/0041* (2013.01); *E05B 2015/041* (2013.01);

(Continued)

(58) Field of Classification Search
CPC ..... E05B 3/04; E05B 3/00; E05B 3/10; E05B 3/003; E05B 3/06; E05B 3/065; E05B 1/00; E05B 1/003; E05B 5/00; E05B 13/106; E05B 15/00; E05B 15/0033; E05B 15/16; E05B 15/04; E05B 15/101; E05B 15/143; E05B 55/00; E05B 55/005; E05B 63/00; E05B 63/0056; E05B 9/00; E05B 9/02; E05B 17/00; E05B 17/0041; E05B 2015/041; E05B 2015/0437; E05B 2015/0448; E05C 19/16
USPC ..... 292/138
See application file for complete search history.

(56) References Cited

U.S. PATENT DOCUMENTS 3,037,764 A * 6/1962 Jean ..... F16F 1/422 267/292
4,641,866 A * 2/1987 Haeck ..... E05C 1/16 16/438

(Continued)

*Primary Examiner* — Nathan Cumar
(74) *Attorney, Agent, or Firm* — Taft Stettinius & Hollister LLP

(57) ABSTRACT

An apparatus that at least assists in maintaining a lever or knob of a lock device in a relatively neutral and static position. The apparatus includes a biasing element that can be constructed from a compliant material that may at least assist in reducing impact forces between interfacing surfaces at least when the lever or knob is returns to the neutral, static position from one or more activated positions. The compliant nature of the damper can further alleviate issues relating to manufacturing tolerances and wear between interfacing surfaces.

24 Claims, 7 Drawing Sheets

Related U.S. Application Data

(60) Provisional application No. 62/312,178, filed on Mar. 23, 2016, provisional application No. 62/313,458, filed on Mar. 25, 2016.

(51) Int. Cl.

| | |
|---|---|
| ***E05B 1/00*** | (2006.01) |
| ***E05B 3/00*** | (2006.01) |
| ***E05B 15/00*** | (2006.01) |
| ***E05B 63/00*** | (2006.01) |
| ***E05B 15/16*** | (2006.01) |
| ***E05B 15/04*** | (2006.01) |
| ***E05B 3/06*** | (2006.01) |
| ***E05B 9/02*** | (2006.01) |
| ***E05B 17/00*** | (2006.01) |

(52) U.S. Cl.
CPC ..... *E05B 2015/0437* (2013.01); *E05B 2015/0448* (2013.01)

(56) References Cited

U.S. PATENT DOCUMENTS

| | | | | |
|---|---|---|---|---|
| 5,265,924 | A * | 11/1993 | Kim | E05B 3/065 292/336.3 |
| 5,335,948 | A * | 8/1994 | Norton, II | E05B 3/065 292/169.23 |
| 5,666,833 | A * | 9/1997 | Gao | E05B 3/065 292/336.3 |
| 5,784,909 | A * | 7/1998 | Huang | E05B 55/005 292/336.3 |
| 5,813,708 | A * | 9/1998 | Shen | E05B 3/065 292/165 |
| 6,807,833 | B1 * | 10/2004 | Huang | E05B 13/101 70/107 |
| 7,073,829 | B2 * | 7/2006 | Kuo | E05B 3/065 292/336.3 |
| 8,360,489 | B2 * | 1/2013 | Cho | E05B 3/065 292/357 |
| 2013/0300136 | A1 * | 11/2013 | Suresha | E05B 3/003 292/336.3 |
| 2015/0308150 | A1 * | 10/2015 | Ludwig | E05B 3/065 292/336.3 |

* cited by examiner

DOOR LOCK CHASSIS ASSEMBLY

CROSS-REFERENCE TO RELATED APPLICATIONS

The present application is a continuation of U.S. patent application Ser. No. 15/466,230 filed Mar. 22, 2017 and issued as U.S. Pat. No. 10,508,468, which claims the benefit of U.S. Provisional Patent Application No. 62/312,178 filed Mar. 23, 2016, and also claims the benefit of U.S. Provisional Patent Application No. 62/313,458 filed Mar. 25, 2016, the contents of each application incorporated herein by reference in their entirety.

TECHNICAL FIELD

Embodiments of the present application generally relate to door locks, and more particularly, but not exclusively, to chassis assemblies for door locks.

BACKGROUND

Door locks often include door knobs or levers that are typically directly or indirectly coupled to a latch of a door lock. Such door knobs or levers typically provide an interface for a user to retract the latch from an extended position to a retracted position. Further, door locks often use springs to bias door handles, such as knobs or levers, to a neutral, un-actuated position that typically corresponds to the associated latch being in the extended position. Accordingly, at least when a door or other entryway device to which the door lock is mounted is in a closed position relative to an associated entryway, the door handle can be biased by the spring to the neutral, and relatively static, unactuated position. Further, with the door handle in the neutral position, the latch, and moreover a latch bolt, may be in an extended position such that the latch extends into a door strike or other opening in an adjacent door frame or wall. Accordingly, in some embodiments, the door may be displaced from the closed position to the open position through manipulation of the door handle. For example, a user may rotate or pivot the handle to an activated position, which causes the latch bolt to be displaced from the extended position to the retracted position. When the latch is in the retracted position, the latch may be at least partially withdrawn from the door strike or adjacent door frame or wall. When the user releases the door handle, such door knobs or levers are often biased back to the neutral, un-actuated position, and the latch returns to the extended position.

The ability to repeatably attain/maintain the door handle at the neutral, un-actuated, and generally static, position is often dependent, at least in part, on the manufactured dimensional accuracy of various component interfaces associated with the operation of the door lock. Accordingly, discrepancies in the dimensional accuracy of various components of the door lock can adversely impact the nature of such component interfaces, as well as the timing of the engagement between those components and/or interfaces. Further, such components are typically manufactured to not only attain/maintain the door handle at the neutral, un-actuated and static position, but to do so in a manner that is aesthetically pleasing, such as, for example, retaining door knobs or levers having relatively linear appearances in a generally horizontal orientation. According to such designs, the inability to attain and/or maintain such horizontality of the door handle, also referred to as lever droop, can be considered by at least some to be aesthetically objectionable, and, in at least some situations, may adversely impact revenues. Efforts to ensure that the component interfaces can retain the door handle at a particular orientation when the door handle is at the neutral, un-actuated position can include tighter manufacturing tolerances for various components of the door lock. Yet, such efforts to tighten manufacturing tolerances can lead to higher part costs, and, in at least in certain situations, may be infeasible to maintain in the long term.

Additionally, the ability to maintain the door knob or lock at the neutral, unactuated and static position over the course of the life of the door lock, particularly as the number of operation cycles accumulate, may be adversely affected by certain interactions and at least occasional striking or impact forces between components of the door lock. Moreover, when a door handle is released from an actuated position at least certain components of the door lock can be accelerated back toward, and into contact with, other components of the door lock as the handle and door lock components return to their respective neutral, un-actuated positions. Such return displacement of certain components can be arrested by a sudden impact with other components of the lock device, such as, for example, a relatively rigid housing, which can also increase the noise associated with the operation of the door lock. Further, such impact can lead to detrimental wear of components of the door lock, and can cause dimensional changes that alter interface clearances between the involved components. These dimensional changes may lead to an increase in the perceptible change in the orientation of the neutral position of the door handle.

BRIEF SUMMARY

One aspect of the present application is directed to an apparatus for a door lock chassis assembly that is structured to be coupled to a handle. The apparatus can include a damper that can be constructed from a compliant material and which is positioned between at least one interface surface between a housing and an actuation mechanism. The actuation mechanism can include one or more engagement sections that are positioned to directly or indirectly couple the actuation mechanism to the handle. Further, the one or more engagement sections can be structured to transmit a biasing force from a biasing element to facilitate the biasing of the handle in an unactuated position. Additionally, the engagement sections can be structured to facilitate rotational displacement of the actuation mechanism as the handle is rotated away from the unactuated position.

Another aspect of the present application is directed to an apparatus for biasing a position of a handle. The apparatus can include a housing having a first side and a second side. The apparatus can also include an actuation plate that can be rotatably coupled to the housing and be rotatably displaceable in a first direction from a neutral position to a first actuation position, as well as in a second direction from the neutral position to a second actuation position, with the first direction being opposite of the second direction. Further, the actuation plate can include one or more engagement sections sized to directly or indirectly couple the actuation plate to the handle. The apparatus can also include a biasing element that is coupled to the actuation plate and which provides a biasing force that biases the actuation plate to the neutral position. The apparatus further includes a damper that is constructed from a compliant material and is positioned between at least one interface between the actuation plate and the housing.

A further aspect of the present application is directed to an apparatus that includes a handle that is rotatably displaceable between an unactuated position and at least one actuated position. The apparatus includes an actuation plate having an actuation body and one or more engagement sections. The one or more engagement sections can be directly or indirectly coupled to the handle, and the actuation plate can be rotatably displaceable from a neutral position. The apparatus can further include one or more dampers constructed from a compliant material, at least one of the one or more dampers being positioned between at least one interface between the actuation plate and the housing. The apparatus also includes a biasing element that can provide a biasing force to bias the actuation plate to the neutral position, at least a portion of biasing element being configured to contact one or more of the one or more dampers as the actuation plate is rotatably displaced to the neutral position. Further, one or more of the engagement sections can at least assist in retaining the handle in the unactuated position when the actuation plate is in the neutral position.

BRIEF DESCRIPTION OF THE DRAWINGS

The description herein makes reference to the accompanying figures wherein like reference numerals refer to like parts throughout the several views.

Figure 1:
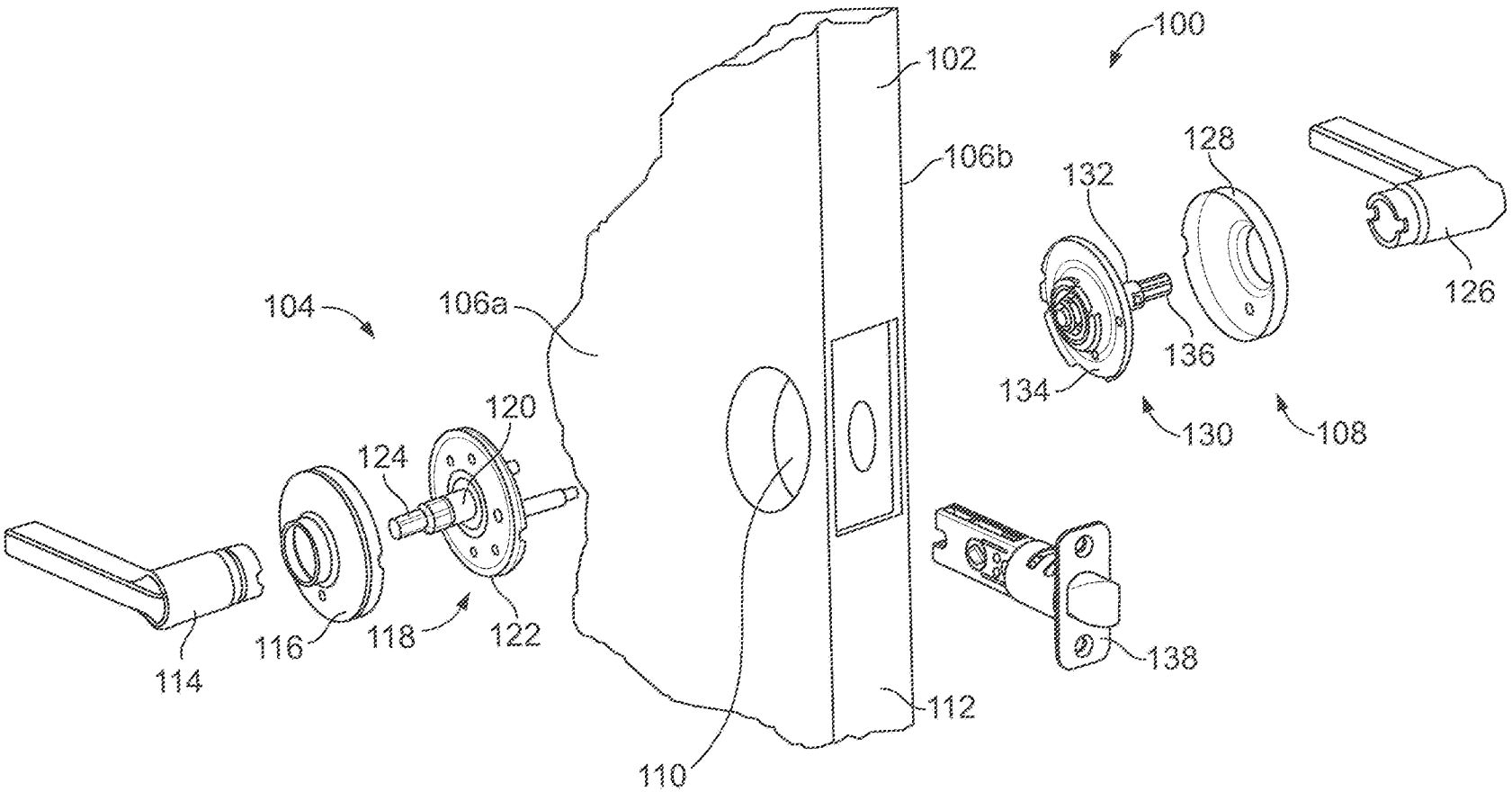
FIG. 1 illustrates an exploded view of an exemplary lock assembly that is structured to be operably mounted or coupled to an entryway device.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates an exploded view of a lock assembly 100 that is structured to be operably mounted or coupled to an entryway device 102, such as, for example, a door or gate, among other devices. The lock assembly 100 includes a first latch assembly portion 104 that is structured to extend from a first 106*a* of the entryway device 102, and a second latch assembly portion 108 that extends from a second side 106*b* of the entryway device 102. Further, at least a portion of the first and second latch assembly portions 104, 108 may extend into a cross-bore 110 in the entryway device 102 that extends along a thickness of at least a portion of the entryway device 102 and between the opposing first and second sides 106*a*, 106*b* of the entryway device 102. The first and second latch assembly portions 104, 108 may also be coupled to a latch assembly 112 that extends into an edge bore 110 formed in a side edge 112 of the entryway device 102 that is generally perpendicular to, and in communication with, the cross-bore 110 in the entryway device 102.

According to certain embodiments, the first latch assembly portion 104 may include a first handle 114, a first rose 116, and a first chassis assembly 118. The first rose 116 can be sized to extend over at least a portion of the first chassis assembly 118 so that the first rose 116 can be positioned to at least assist in covering or concealing the first chassis assembly 118 from view at least when the lock assembly 100 is operably mounted or coupled to an entryway device 102. In certain embodiments, the first rose 116 can provide a decorative plate or cover that may enhance the aesthetics of the lock assembly 100.

According to certain embodiments, the first chassis assembly 118 includes a first chassis spindle 120 that extends through at least a portion of a first spring cage assembly 122. The first chassis spindle 120 is sized for engagement with at least a first drive spindle 124 to rotationally couple therewith. For example, according to certain embodiments, at least a portion of the first chassis spindle 120 may receive insertion of the first drive spindle 124 such that rotational displacement of the first chassis spindle 120 is translated into rotational displacement of at least the first drive spindle 124. The first chassis spindle 120 may be rotationally coupled with the first drive spindle 124 via mating portions having non-circular shapes and/or a mechanical fastener, such as a pin, screw, or key. The first drive spindle 124 may also be coupled to the first handle 114, such as, for example, via engagement with a mating recess in the first handle 114. According to such embodiments, the first drive spindle 124 may be coupled to the first handle 114 and extend into at least the first chassis spindle 120 such that rotational or pivotal displacement of the first handle 114 is translated by the first drive spindle 124 into rotational displacement of the first chassis spindle 120.

Similarly, the second latch assembly portion 108 can include a second handle 126, a second rose 128, and a second chassis assembly 130. The second rose 128 can be sized to extend over at least a portion of the second chassis assembly 130 so that the second rose 128 can be positioned to at least assist in covering or concealing the second chassis assembly 130 from view at least when the lock assembly 100 is operably mounted or coupled to an entryway device 102.

In certain embodiments, the second rose 128 can provide a decorative plate or cover that may enhance the aesthetics of the lock assembly 100.

According to certain embodiments, the second chassis assembly 130 includes a second chassis spindle 132 that extends through at least a portion of a second spring cage assembly 134. The second chassis spindle 132 is sized for engagement with at least a second drive spindle 136 to rotationally couple therewith. For example, according to certain embodiments, at least a portion of the second chassis spindle 132 may receive insertion of the second drive spindle 136 such that rotational displacement of the second chassis spindle 132 is translated into rotational displacement of at least the second drive spindle 136. The second chassis spindle 132 may be rotationally coupled with the second drive spindle 136 via mating portions having non-circular shapes and/or a mechanical fastener, such as a pin, screw, or key. The second drive spindle 136 may also be coupled to the second handle 126, such as, for example, via engagement with a mating recess in the second handle 126. According to such embodiments, the second drive spindle 136 may be coupled to the second handle 126 and extend into at least the second chassis spindle 132 such that rotational or pivotal displacement of the second handle 126 is translated by the second drive spindle 136 into rotational displacement of the second chassis spindle 132.

According to the illustrated embodiment, at least a portion of the first and second chassis assemblies 118, 130 can extend into the cross-bore 110 in the entryway device 102 and can be coupled to the latch assembly 112. Moreover, the first and second chassis assemblies 118, 130 may each be operably coupled to the latch assembly 112 such that rotation of the first or second chassis spindles 120, 132 of the first and/or second chassis assemblies 118, 130 is translated into linear displacement of a latch bolt 138 of the latch assembly 112 between an extended position and a retracted position. In the illustrated form, each of the handles 114, 126 is provided in the form of a lever-type handle. It is also contemplated that one or both of the handles 114, 126 may be provided in the form of a knob-type handle.

Figure 2:
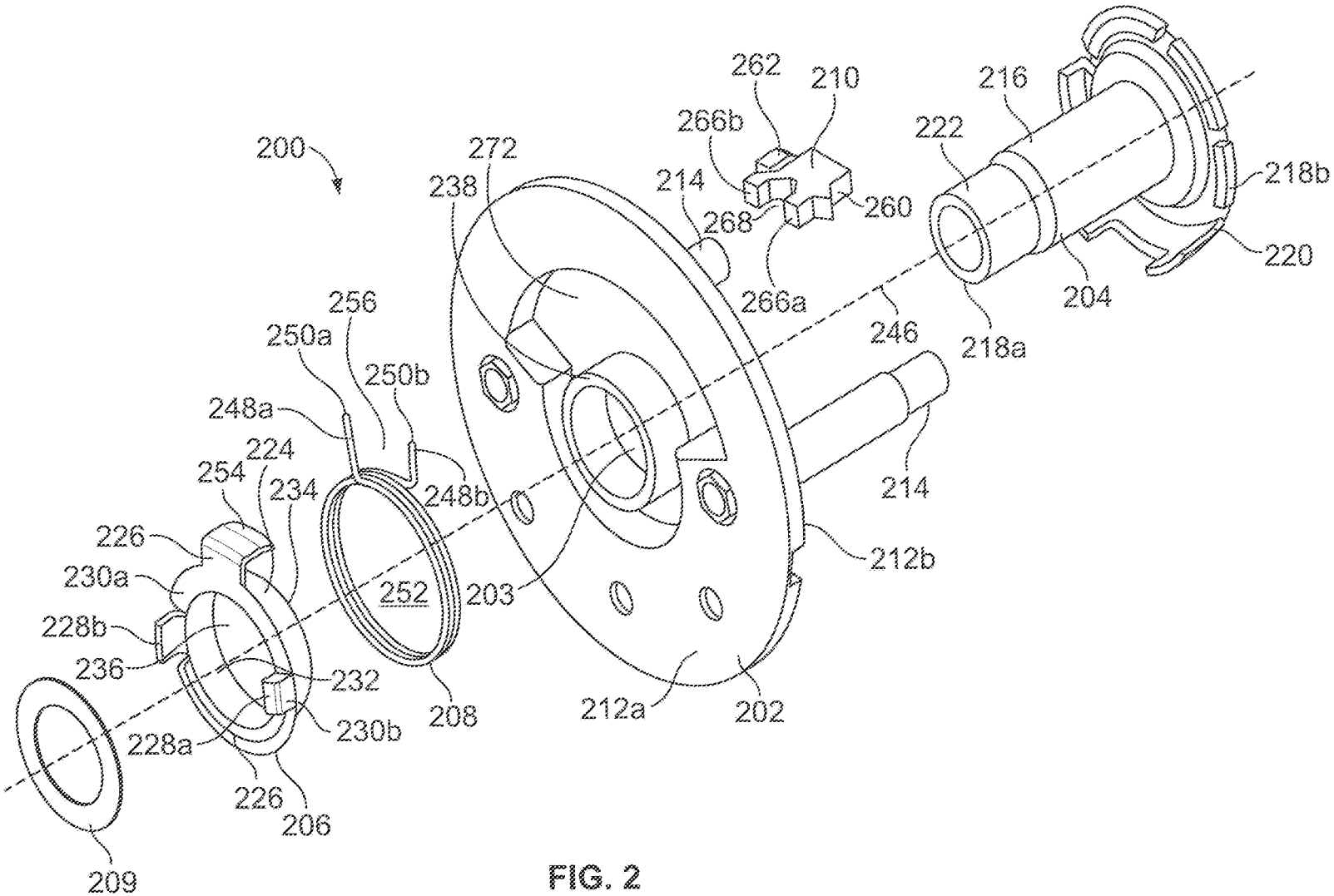
FIG. 2 illustrates an exploded perspective view of an exemplary door lock chassis assembly according to an embodiment of the present application.

FIG. 2 illustrates an exploded perspective view of a door lock chassis assembly 200 according to one embodiment. In the illustrated embodiment, the door lock chassis assembly 200 can be adapted to be used as either or both of the first and second chassis assemblies 118 130, and includes a housing 202, a spindle 204, an actuation plate or mechanism 206, a biasing element 208, and a damper 210. Optionally, the door lock chassis assembly 200 can also include a washer or spacer 209 that can be operably positioned between the actuation plate 206 and the handle 114, 126. The housing 202 can having opposite first and second sides 212*a*, 212*b* and be structured to provide a relatively fixed structural member for the door lock chassis assembly 200. For example, referencing FIGS. 1 and 2, the housing 202 can be part of the first chassis assembly 118 and be structured to at least assist in the coupling of the first chassis assembly 118 to the second chassis assembly 130 and/or to the entryway device 102. According to certain embodiments, the housing 202 can include one or more posts 214 extending from the second side 212*b* of the housing 202. The posts 214 may be structured for a threaded engagement with a mechanical fastener, such as a bolt or screw, that can be coupled to the second chassis assembly 130. Further, the housing 202 can be constructed from a variety of materials, including, for example, a metal having a relatively low surface hardness. By way of example, the housing 202 may be formed of a metal having Brinell Hardness Number (BHN) of around 100 or less, among other materials and levels of surface hardness.

The spindle 204 includes a spindle sleeve 216 having a first end portion 218*a* and an opposite second end portion 218*b*. The spindle 204 also includes a spindle plate 220, which is joined to the second end portion 218*b* of the spindle sleeve 216, and extends radially outwardly therefrom. Further, at least a portion of the spindle sleeve 216 is sized to extend through an aperture 203 in the housing 202. According to the illustrated embodiment, the spindle plate 220 may abut the second side 212*b* of the housing 202, while at least a portion of the spindle sleeve 216 extends through the aperture 203 and away from the first side 212*a* of the housing 202.

The first end portion 218*a* of the spindle sleeve 216 can be configured to be rotationally coupled to the handle 114, 126 and/or associated trim of the handle 114, 126. For example, according to the illustrated embodiment, the first end 218*a* of the spindle sleeve 216 includes a non-circular engagement portion 222 that is shaped to directly or indirectly be coupled to the handle 114, 126 such that rotational displacement of the spindle 204 may be translated to the handle 114, 126, and vice versa. However, in addition to, or in lieu of, using a non-circular configuration, the engagement portion 222 of spindle sleeve 216 can be operably coupled to the handle 114, 126 in a variety of other manners, including, but not limited, a pin, screw, bolt, clamp, and/or adhesive, among other connections.

The actuation plate 206 can be structured to interface, either directly or indirectly, with the handle 114, 126. More specifically, the actuation plate 206 can be structured to transmit a torque from the handle 114, 126 to the biasing element 208, and vice versa. In the illustrated embodiment, the actuation plate 206 includes a body portion or segment 224, one or more retention segments 226, and one or more engagement sections 228*a*, 228*b*. The body portion 224 can include a first side 230*a*, a second side 230*b*, an inner wall 232, and an outer wall 234. The inner wall 232 generally defines an opening 236 that is sized to accommodate placement of the actuation plate 206 about a hub 238 on the first side 212*a* of the housing 202. Moreover, the opening 236 can be sized to accommodate rotational displacement of the actuation plate 206 about at least a portion of the hub 238. Additionally, according to the illustrated embodiment, the second side 230*b* of the body portion 224 may, when the actuation plate 206 is positioned about the hub 238 of the housing 202, abut or be generally adjacent to the first side 212*a* of the housing 202. Further, the actuation plate 206 can be constructed from a variety of materials, including, but not limited to, a metal having a relatively low surface hardness, such as, for example, a Brinell Hardness Number (BHN) of around 100 or less.

The engagement section 228*a*, 228*b* of the actuation plate 206 are sized to provide an interface between the actuation plate 206 and the handle 114, 126. For example, as shown in at least FIGS. 2-5, according to certain embodiments, the engagement section 228*a*, 228*b* may comprise one or more outwardly extending tabs that are positioned to engage, either directly or indirectly, one or more adjacent abutment surfaces 240*a*, 240*b* of the handle 114, 126. Further, the one or more engagement sections 228*a*, 228*b* and the one or more corresponding abutment surfaces 240*a*, 240*b* can be positioned at a variety of locations about the actuation plate 206 and handle 114, 126, respectively. For example, according to certain embodiments, the first abutment surface 240*a* and adjacent first engagement section 228*a*, and the second abutment surface 240*b* and adjacent second engagement section 228*b*, may be on opposite sides of a central axis 246 of the chassis assembly 200. The one or more engagement sections 228*a*, 228*b* of the actuation plate 206 can be configured for engagement with the corresponding one or more adjacent abutment surfaces 240*a*, 240*b* such that rotational displacement of one of the actuation plate 206 and the handle 114, 126 may be translated to the other of the actuation plate 206 and the handle 114, 126. Additionally, the one or more engagement sections 228*a*, 228*b* of the actuation plate 206 can be configured for engagement with the corresponding one or more adjacent abutment surfaces 240*a*, 240*b* in a manner that at least assists in maintaining the handle 114, 126 in the neutral, unactuated position.

Which abutment surfaces 240*a*, 240*b* engages which portions of the engagement sections 228*a*, 228*b* can depend on the direction of rotational displacement as well as the configuration or position of the abutment surfaces 240*a*, 240*b* and engagement sections 228*a*, 228*b*. For example, according to the embodiment shown in FIGS. 2-5, two opposing abutment surfaces 240*a*, 240*b* on the first side 230*a* of the body portion 224 can be positioned for engagement with one or more of the engagement sections 228*a*, 228*b* so as to provide an interface between the actuation plate 206 and the handle 114, 126 that at least assists in transmitting rotational forces therebetween. Moreover, as indicated by FIG. 5, according to certain embodiments, the abutment surfaces 240*a*, 240*b* can generally define a space or cavity 244 in the handle 114, 126 that receives the placement of an adjacent engagement section 228*a*, 228*b*. According to such an embodiment, rotation of the actuation plate 208 in a first direction can result in a first side 242*a* of a first engagement section 228*a* being in engagement with an adjacent first abutment surface 240*a* in a manner that causes the handle 114, 126 to rotate in the first direction. Additionally, according to certain embodiments, such rotation in the first direction can also result the second engagement section 228*b* being engaged with an adjacent second abutment surface 240*b*, which can also assist in facilitation rotation of the handle 114, 126 in the first direction. Conversely, rotation of the actuation plate 208 in an opposite second direction can result in the first engagement section 228*a* being in engagement with an adjacent second abutment surface 240*b*, and the second engagement surface 228*b* being in engagement with an adjacent first abutment surface 240*a*, thereby causing the handle 114, 126 to rotate in the second direction.

While certain above examples may be discussed in terms of rotational displacement of the actuation plate 206 being translated into rotational displacement of the handle 114, 126, it is to be appreciated that rotational displacement of the handle 114, 126 can similarly be translated to rotational displacement of the actuation plate 206. Moreover, rotational displacement of the handle 114, 126 (such as, for example, by a user manipulating the handle 114, 126) can result in, based on the direction of displacement, the first abutment surface 240*a* exerting a force against the first side 242*a* of the adjacent engagement section 228*a*, or the second abutment surface 240*b* exerting a force against the second side 242*b* of the adjacent engagement section 228*a* that facilitates the rotational displacement of the actuation plate 206.

According to other embodiments, one or more of the engagement sections 228*a*, 228*b* may be positioned adjacent a single abutment surface 240*a*, 240*b*. According to such an embodiment, when rotated in one direction, the first engagement section 228*a* may be engaged with an adjacent first or second abutment surface 240*a*, 240*b* so as to facilitate rotational displacement of the actuation plate 206 and/or the handle 114, 126, and the second engagement section 228*b* is not engaged with and adjacent first or second abutment surface 240*a*, 240*b*. According to such an embodiment, when rotated in another, opposite direction, the second engagement section 228*b* may be engaged with an adjacent first or second abutment surface 240*a*, 240*b* so as to facilitate rotational displacement of the actuation plate 206 and/or the handle 114, 126, and the first engagement section 228*a* is not engaged with and adjacent first or second abutment surface 240*a*, 240*b*. Alternatively, according to certain embodiments, the first and second abutment surfaces 240*a*, 240*b* may be coupled to the associated, adjacent first and second engagement sections 228*a*, 228*b* (such as, for example, by a pin, clip, clap, or press fit, among other arrangements and connections), such that when the first engagement section 228*a* and the first abutment surface 240*a* are in a pushing or pressing relationship that facilitates rotational displacement, the second engagement section 228*b* and the second abutment surface 240*b* are in a pulling relationship.

According to the illustrated embodiment, the biasing element 208 can provide a centralizing preload torque to hold the handle 114, 126 in a neutral, unactuated position. The biasing element 208 can also provide a return torque when the handle 114, 126 is actuated by a user. More specifically, when the user releases the handle 114, 126, the return torque will urge the handle 114, 126 back to the unactuated position. The actuation plate 206 may be sized to accommodate the placement, or otherwise accommodate the structure and/or position of the biasing element 208. For example, according to the illustrated embodiment, the biasing element 208 can be a generally cylindrical shaped torsion spring having a first arm 248*a* at a first end 250*a* of the biasing element 208, and a second arm 248*b* at a second end 250*b* of the biasing element 208. According to such an embodiment, the biasing element 208 may include an aperture 252 that accommodates the placement of the biasing element 208 about the outer wall 234 of the body portion 224 of actuation plate 206.

Additionally, the body portion 224 of the actuation plate 206 may include one or more retention segments 226 that outwardly extend from around a portion of the first side 230*a* and/or outer wall 234 in a manner that may facilitate the biasing element 208 being retained at a lateral position between the retention segments 226 of the actuation plate 206 and the housing 202, as shown in at least FIG. 5. Further, the torsion spring of the biasing element 208 can be constructed from a variety of different materials, including, but not limited to, cold drawn spring wire having, for example, a surface hardness of a Rockwell C (RC) of around 50 RC to around 60 RC, among other levels or surface hardness and/or materials.

The actuation plate 206 includes at least one actuation body 254 that is positioned for engagement with at least a portion of the biasing element 208. The actuation body 254 may be considered to define at least a portion of a projection of the actuation plate 206. According to the illustrated embodiment, engagement between the biasing element 208 and the actuation body 254 may be used to bias at least the actuation plate 206 to a neutral position that can be associated with the latch bolt 138 being at a predetermined position, such as the extended position or the retracted position. The actuation body 254 can have a variety of shapes and sizes. For example, according to the illustrated embodiment, the actuation body 254 can be positioned in a space 256 between the first and second arms 248*a*, 248*b* of the biasing element 208 in a manner in which the actuation body 254 is engaged with one or more of the first and second arms 248*a*, 248*b* of the biasing element 208. The at least one actuation body 254 can outwardly extend from the body portion 224 of the actuation body 254 so as to be positioned to engage a portion of the biasing element 208, such as, for example, a lower portion 258*a* of the first arm 248*a* and/or the second arm 248*b*. Furthermore, according to certain embodiments, the actuation body 254 may extend from the one or more retention segments 226, as shown, for example, by at least FIG. 5.

According to the illustrated embodiment, the damper 210 may be configured to at least assist in maintaining the position/orientation of the biasing element 208 when at a rest position and/or to dampen the return of the biasing element 208 to the neutral, unactuated position. The damper 210 may be constructed from a variety of different materials, including, but not limited to, a material that may provide sufficient rigidity to maintain the biasing element 208 at the rest position, is shock absorbent, and/or is wear resistant. For example, according to certain embodiments, the damper 210 may be constructed from a rubber or elastomeric material having a hardness that is optimized for wear resistance, and which can provide a degree of structural performance or support characteristics.

The damper 210 may have a variety of different shapes and sizes. According to the illustrated embodiment, as shown by at least FIGS. 2-5, the damper 210 can include a main section 260 and an extension section 262. The main section 260 can be configured to be received in an opening 264 in the housing 202. Further, the main section 260 can be used to secure the damper 210 to the housing 202. For example, according to certain embodiments, the main section 260 and/or the opening 264 of the housing 202 can be sized to provide a press or interference fit between the main section 260 and portions of the housing 202 that generally define the opening 264. However, the damper 210 can be coupled to the housing 202 in a variety of other manners in addition to, or in lieu of, an interference or press fit. For example, according to embodiments in which the housing 202 does, or does not, include an opening 264 that receives at least a portion of the damper 210, the damper 210 can be secured or affixed to the housing 202 via a mechanical fastener and/or an adhesive. For example, according to certain embodiments, the damper 201 can at least partially be secured to the housing 202 via the use of a pin, screw, bolt, rivet, snap-fit and/or clamp. According to other embodiments, the damper 210 can be secured to the housing 202 via use of a glue, resin, and/or plastic weld, among other fasteners.

The opening 264 of the housing 202 and the main section 260 of the damper 210 can be sized such that the housing 202 provides structural integrity to the damper 210. The extension section 262 can include a first segment 266*a* and a second segment 266*b* that are separated by a gap 268. Further, according to certain embodiments, the gap 268 can be sized to accommodate the positioning of a rib 270 of the housing 202 between the first and second segments 266*a*, 266*b*. The rib 270 may be considered to define at least a portion of a projection of the housing 202. The first and second segments 266*a*, 266*b* may further be configured to contact an upper portion 258*b* of the adjacent first and second arms 248*a*, 248*b* of the biasing element 208. According to such an embodiment, the rib 270 may provide a degree of rigidity and/or structural integrity to the first and/or second segments 266*a*, 266*b*. Additionally, the first and second segments 266*a*, 266*b* may provide a dampening or cushion effect that prevents the first and second arms 248*a*, 248*b* of the biasing element 208 from directly striking or otherwise impacting the rib 270 of the housing 202. Alternatively, according to other embodiments in which the housing 202 does not a rib 270, the extension 262 of the damper 210 may not include a gap 268. For example, according to certain embodiments, the first and second segments 266*a*, 266*b* can be a single segment that extends across the extension 262.

According to certain embodiments, the deformation and/or deflection capabilities of the damper 210 may allow the damper 210 to have relatively larger size tolerances for at least purposes of manufacturing. This may enable the damper 210 to provide an operationally compliant component that provides localized tuning of the interface between at least the biasing element 208, damper 210, housing 202, and/or the actuation plate 206, without at least some of the same degree of traditional size tolerance limitations. The deformation and/or deflection capabilities of the damper 210 may additionally or alternatively enable the damper to provide a compliant component that maintains an operational size, shape and/or interfaces for a relatively longer period of time and/or a larger number of operation cycles. For example, referencing the lock chassis assembly 200 being in the neutral, unactuated position (FIG. 2), with the housing 202, actuation plate 206, and the biasing element 208 being constructed from relatively rigid materials, the introduction of the damper 210 may facilitate simultaneous contact at interfaces between the actuation plate 206 and first and second arms 248*a*, 248*b* of the biasing element 208, as well as interfaces between the first and second arms 248*a*, 248*b* of the biasing element 208 and the damper 210. Moreover, the compliant nature of the damper 210, including the conformity of the material of the damper 210, can at least assist in the damper 210 being able to conform to the geometry of at least a portion of the biasing element 208 that engages the damper 210, as well as the positioning or size of the rib 270. Thus, such conformity of the damper 210 can compensate for relatively large manufacturing tolerances associated with actuation body 254 and the rib 270 of the housing 202. Further, the compliant nature of the damper 210 and the ability to compensate for certain discrepancies in the geometric interfaces between the damper 210, biasing element 208, housing 202, and/or actuation plate 206 can at least assist in minimizing perceptible droop and/or rattle of the handle 114, 126.

Thus, according to the illustrated embodiment, during lock operation, the damper 210 can be able to change shape as a result of relatively high, localized surface stresses imposed on the damper 210 from the biasing element 208. Rather than localized permanent yielding, the damper 210 can experience localized and at least relatively temporary deformation when exposed to the loads from the biasing element 208. Upon removal of those loads, the damper 210 can regain its prior, generally non-deformed shape. Additionally, with appropriate material selection, wear from relative motion at interfaces between the damper 210 and the biasing element 208 can be reduced or eliminated. Further, using such an embodiment can minimize rotational clearances at the interfaces between the damper 210 and the biasing element 208 that otherwise could result from wear, which help improve long-term droop and rattle performance of the lock chassis assembly 200 as the number of operational cycles are accumulated.

Figure 4A:
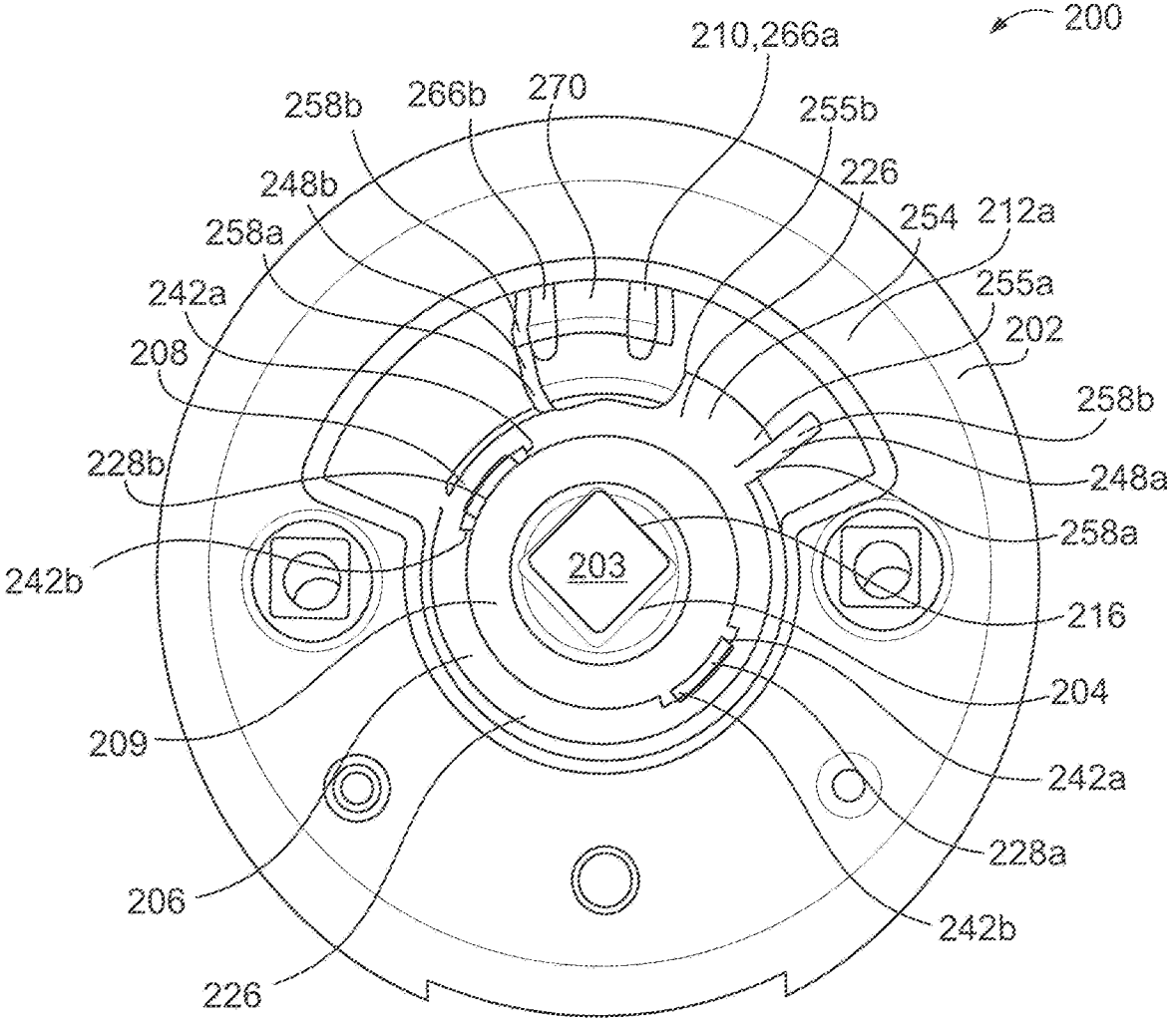
FIG. 4A illustrates a first side view of the door lock chassis assembly shown in FIG. 2 in a first rotated, actuated position.
Figure 5:
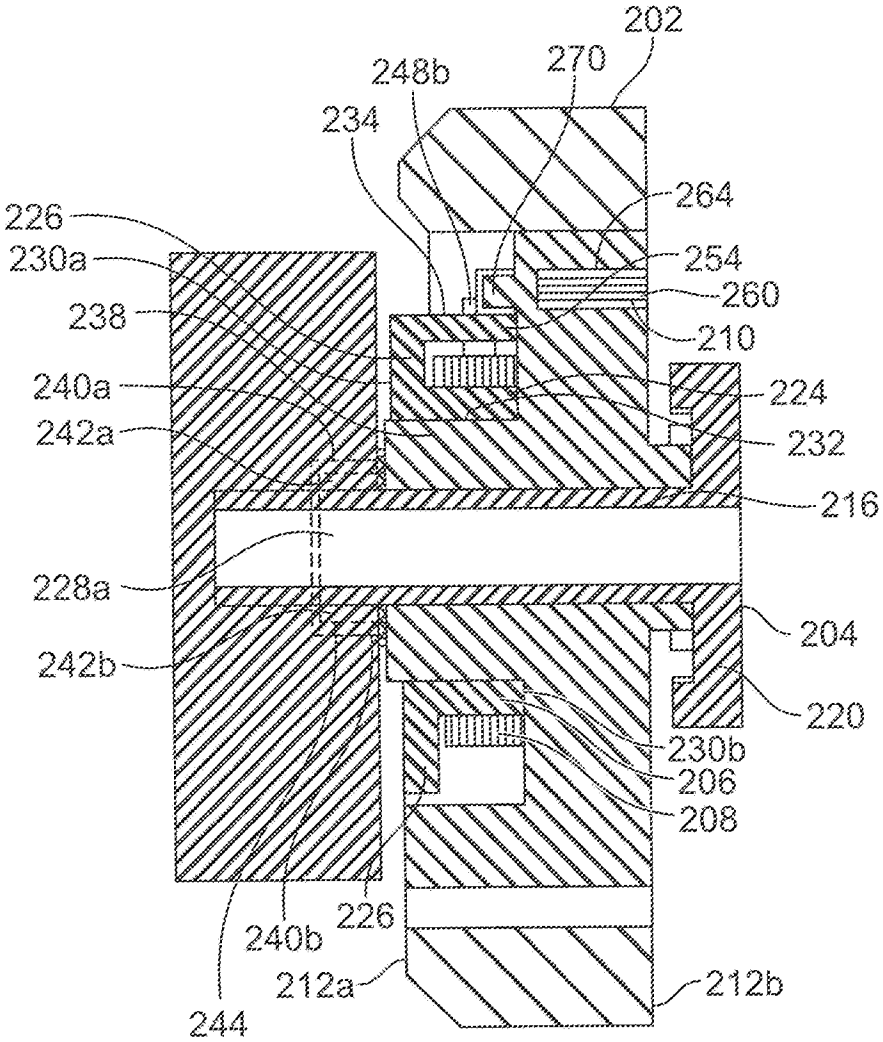
FIG. 5 illustrates a cross-sectional view of the exemplary lock chassis assembly taken along line A-A of FIG. 3A.

FIG. 4A illustrates the lock chassis assembly 200 in a state in which a rotational force exerted on the rotated the handle 114, 126 in a first direction (such as, for example, by a user manipulating the handle 114, 126) has displaced the lock chassis assembly 200 to a first actuated position. As discussed above, such rotation of the handle 114, 126 can be translated to the engagement section 228*a*, 228*b* of the actuation plate 206 in a manner that can facilitate rotational displacement of the actuation plate 206. Such rotation of the actuation body 254 in the first direction can result in a first side 255*a* of the actuation body 254 exerting a force against the first arm 248*a* of the biasing element 208 in a manner that rotatably displaces the first arm 248*a* with the actuation body 254. Further, while the actuation body 254 and first arm 248*a* are rotated, the second segment 266*b* of the damper 210 and/or the rib 270 of the housing 202 can be positioned to prevent or minimize similar rotation of the second arm 248*b* of the biasing element 208, thereby allowing for an increase in the size of the space 256 between the first and second arms 248*a*, 248*b* of the biasing element 208. Thus, during actuation of the lock chassis assembly 200 to the first actuated position, the second arm 248*b* remains in contact with the damper 210 while the first arm 248*a* is carried by the actuation body 254 such that the first arm 248*a* moves out of contact with the damper 210. Moreover, such a change in the distance or space 256 between the first and second arms 248*a*, 248*b* can be associated with the biasing element 208 being changed from an unactuated state to an actuated state, wherein the biasing element 208 provides a force that seeks to return at least the biasing element 208 to the unactuated state.

Further, as shown in FIG. 4A, when in the first actuated position, the upper portion 258*b* of the second arm 248*b* of the biasing element 208 and the second segment 266*b* of the damper 210, as well as the interface between the lower portion 258*a* of the first arm 248*a* of the biasing element 208 and the first side 255*a* of the actuation body 254, are in engaged states. Conversely, at the first actuation position, the interface between the upper portion 258*b* of the first arm 248*a* of the biasing element 208 and the first segment 266*a* of the damper 210 actuation body 254, as well as the interface between the lower portion 258*a* of the second arm 248*b* of the biasing element 208 and the second side 255*b* of the actuation body 254 are in disengaged states. From the first actuated position, when the force that displaced the handle 114, 126 away from the neutral, unactuated position is released or otherwise removed, the biasing element 208 can provide a force that urges the above-identified rotated components of the assembly 200 back to the neutral or unactuated positions illustrated in FIG. 3A.

Figure 3A:
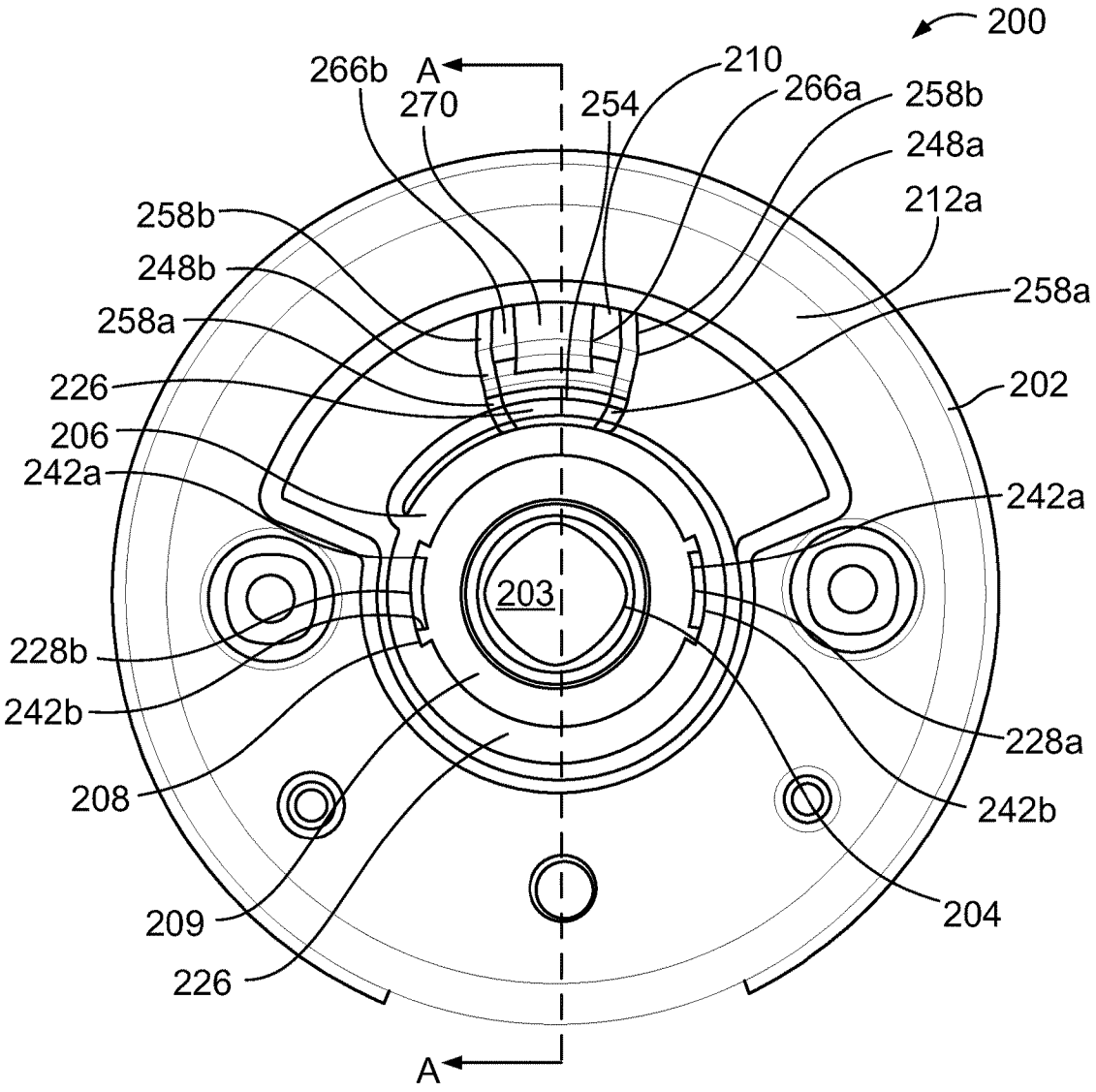
FIG. 3A illustrates a first side view of the door lock chassis assembly shown in FIG. 2 in a neutral, unactuated position.
Figure 3B:
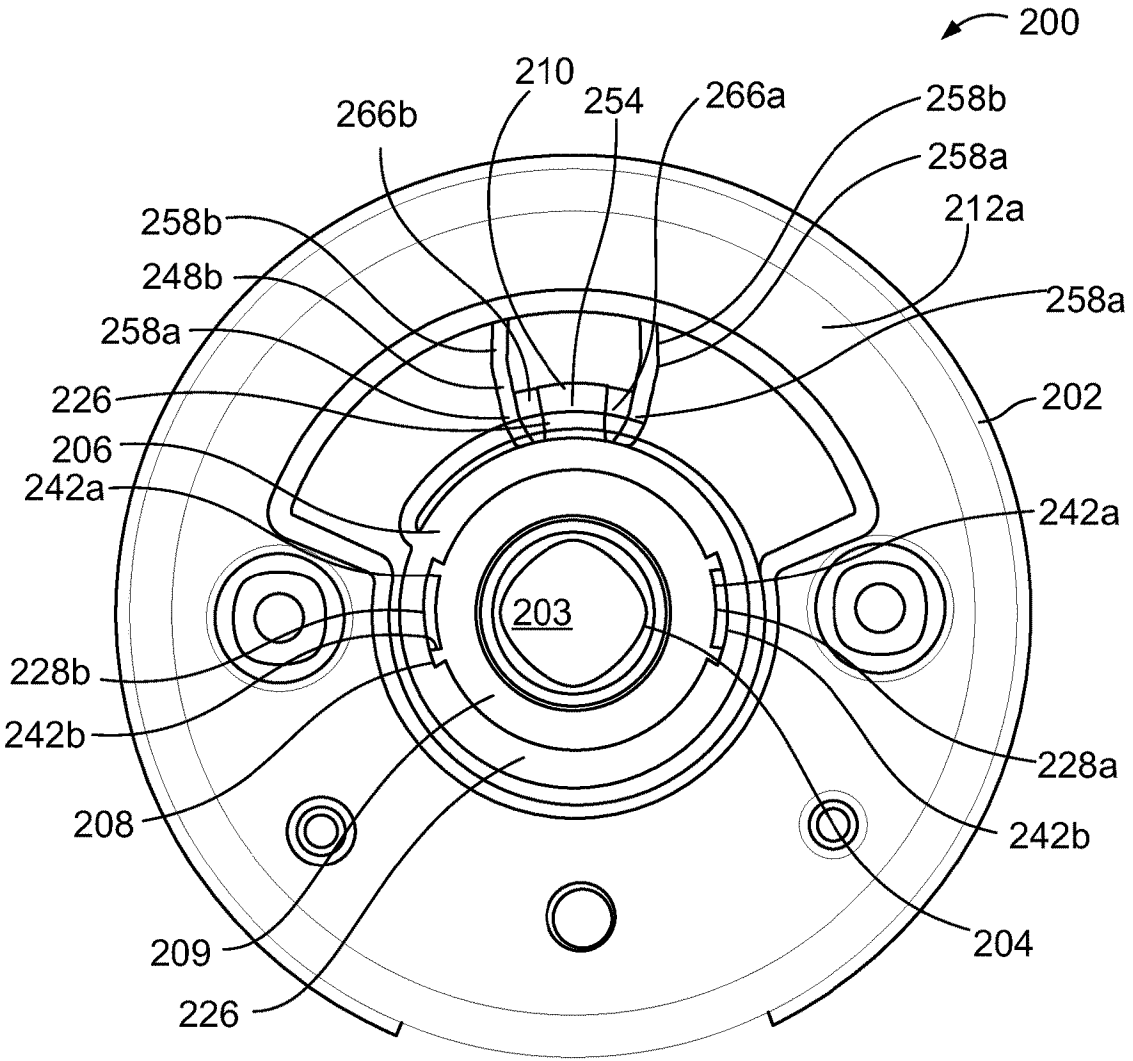
FIG. 3B illustrates a first side view of the door lock chassis assembly in a neutral, unactuated position, and in which a damper is positioned to provide a cushion between a biasing element and an actuator.

According to certain embodiments, at least a portion of the damper 210 can be positioned about one or both of the first and second sides 255*a*, 255*b* of the actuation body 254, as shown, for example, by FIG. 3B. For example, according to certain embodiments, rather than being coupled to the housing 202, the damper 210 can be coupled to the actuation body 254 so that the interface between the first and/or second sides 255*a*, 225*b* at least when the actuation body 254 returns to the neutral, static position is not directly with the housing 202, but instead with the damper 210. Moreover, such a configuration can allow the damper 210 to remain between interfacing portions of the first and/or second sides 255*a*, 255*b* of the actuation body 254 and the corresponding interfacing surfaces of the housing 202, such as, for example, the rib 270.

According to other embodiments, a first portion of damper 210 can be coupled to the housing 202, such as the rib 270, while a second portion of the damper 210 is coupled to the first and/or second sides 255*a*, 255*b* of the actuation body 254. Thus, according to such an embodiment, at least a first portion of the damper 210 that is coupled to the housing 202, and at least a second portion of the damper 210 that is coupled to the actuation body 254 can be positioned to prevent direct contact between the first and/or second sides 255*a*, 255*b* of the actuation body 254 and the housing 202 at least when the actuation body 254 returns to the neutral, static position. For example, according to certain embodiments in which the housing includes a rib 270, a damper 210 can be positioned on both sides of the rib 270, and another damper 210 can be positioned along both the first and second sides 255*a*, 255*b* of the actuation body 254. According to such an embodiment, at least when the actuation body 254 returns to the neutral, static position, the interface between one side of the rib 270 and the first side 255*a* of the actuation body 254 and/or the interface between the other side of the rib 270 and the second side 255*b* of the actuation body 254 may be separated by two layers of damper 210.

In connection with the return from the first, actuated position to the neutral, unactuated position, the return force provided by the biasing element 208 can cause the upper portion 258*b* of the first arm 248*a* to impact the first segment 266*a* of the damper 210 as the first arm 248*a* returns to its neutral, unactuated position. Such impact may allow the damper 210 to relatively cushion at least the biasing element 208 as such displacement of the biasing element is brought to a stop. Further, the damper 150 can isolate the rib 270 of the housing 202 from yielding and/or wear that might otherwise occur from such impact forces. Additionally, as the actuation body 254 returns to its corresponding neutral, unactuated position, the force provided by the biasing element 208 can at least assist in the actuation body 254 impacting the lower portion 258*a* of the second arm 248*b* of the biasing element 208. However, the compliant nature of the damper 210 may allow a degree of movement of the first spring arm 248*a* relative to the damper 210, which may accommodate a degree of corresponding movement of the second arm 248*b* associated by the impact of the actuation body 245 against the second arm 248*b*, thereby providing a degree of cushion for such impact between the actuation body 245 and the second arm 248*b*. Further, according to the illustrated embodiment, as the biasing element 208 can be constructed from a material that is relatively much harder material than at least the housing 202 and actuation plate 206, the impact forces at least between the biasing element 208 and the damper 210 and/or actuation plate 206 can be large enough to cause localized yielding of the damper 210, housing 202, and/or the actuation plate 206.

Figure 4B:
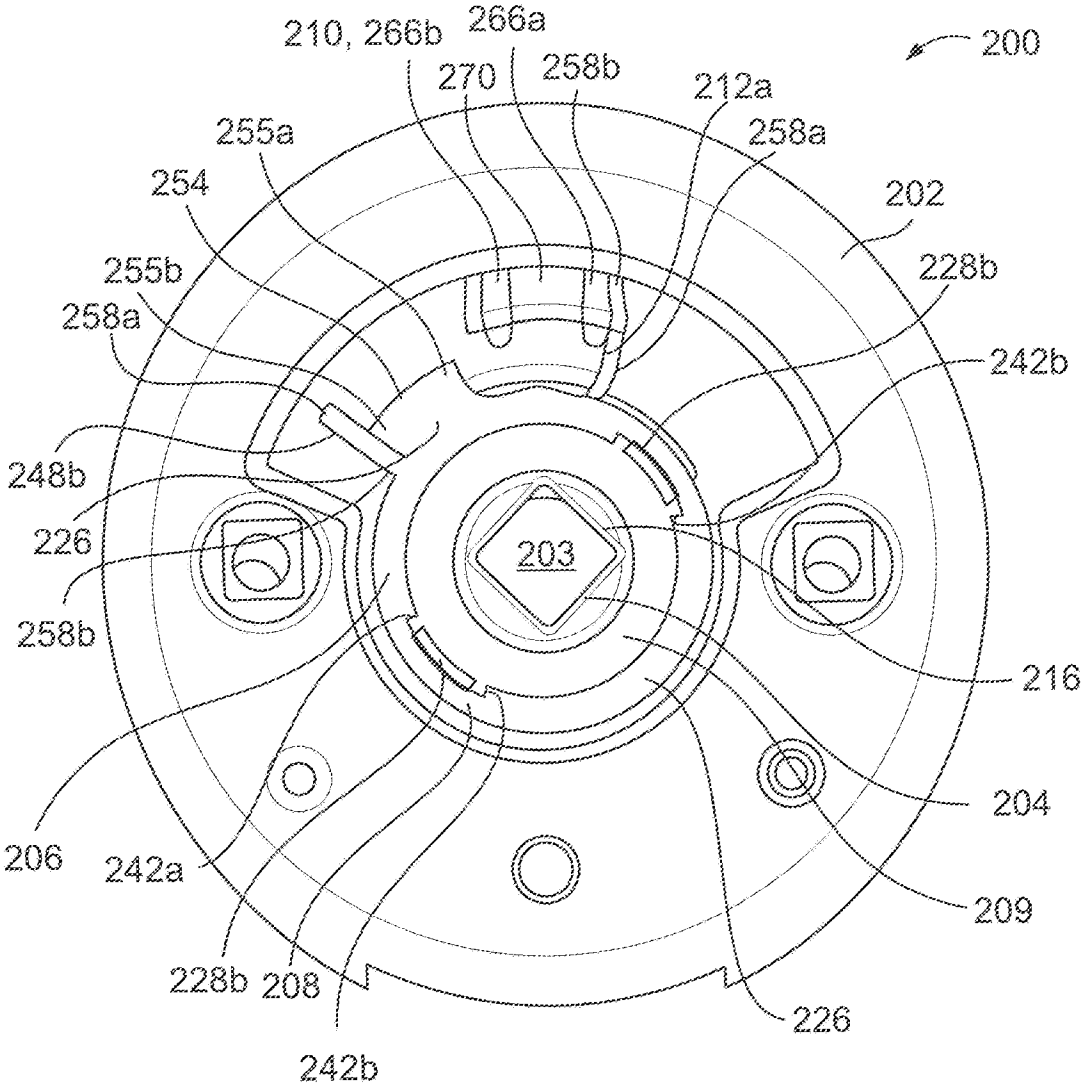
FIG. 4B illustrates a first side view of the door lock chassis assembly shown in FIG. 2 in a second rotated, actuated position.

FIG. 4B illustrates the lock chassis assembly 200 in a state in which a rotational force exerted on the rotated the handle 114, 126 in a second direction that is opposite of the first direction that is depicted in FIG. 4A has resulted in the rotational displacement of the lock chassis assembly 200 to a second actuated position. Such rotation in the second direction may be similar to the rotation in the first direction, but can result in engagement and disengagement of opposite portions and/or segments of the rotated components. For example, such rotational displacement from the neutral, unactuated position to the second actuated position can include the second side 255*b* of the actuation body 254 exerting a force against the second arm 248*b* of the biasing element 208 in a manner that rotatably displaces the second arm 248*b* of the biasing element 208. Further, while the actuation body 254 and the second arm 248*b* are rotatably displaced, the first segment 266*a* of the damper 210 and/or the rib 270 of the housing 202 can be positioned to prevent or minimize similar rotation of the first arm 248*a* of the biasing element 208, thereby allowing for an increase in the size of the space 256 between the first and second arms 248*a*, 248*b* of the biasing element 208. Thus, during actuation of the lock chassis assembly 200 to the second actuated position, the first arm 248*a* remains in contact with the damper 210 while the second arm 248*b* is carried by the actuation body 254 such that the second arm 248*b* moves out of contact with the damper 210. Again, such a change in the distance or space 256 between the first and second arms 248*a*, 248*b* can be associated with the biasing element 208 being changed from an unactuated state to an actuated state, wherein the biasing element 208 provides a force that seeks to return at least the biasing element 208 to the neutral, unactuated state.

Further, as shown in FIG. 4B, when in the second actuated position, the interface between the upper portion 258*b* of the second arm 248*b* of the biasing element 208 and the second segment 266*b* of the damper 210, as well as the interface between the lower portion 258*b* of the first arm 248*a* of the biasing element 208 and the first side 255*a* of the actuation body 254, are in a disengaged state. Conversely, at the second actuation position, the interface between the lower portion 258*a* of the second arm 248*b* of the biasing element 208 and the second side 255*b* of the actuation body 254, as well as the interface between the upper portion 258*b* of the first arm 248*a* of the biasing element 208 and the first segment 266*a* of the damper 210, are in an engaged state. From the second actuated position, when the force that displaced the handle 114, 126 away from the neutral, unactuated position to the second actuated position is released or otherwise removed, the biasing element 208 can provide a force that urges the above-identified rotated components of the assembly 200 back to their corresponding neutral, unactuated positions, as shown in FIG. 3.

In connection with the return from the second actuated position to the neutral, unactuated position, the return force provided by the biasing element 208 can cause the upper portion 258*b* of the second arm 248*b* to impact the second segment 266*b* of the damper 210 as the second arm 248*b* returns to its neutral, unactuated position. Similarly, as the actuation body 254 returns to its corresponding neutral, unactuated position, the force provided by the biasing element 208 can at least assist in the first side 255*a* of the actuation body 254 impacting the lower portion 258*a* of the first arm 248*a* of the biasing element 208. Yet, similar to the above discussion regarding the return to the neutral, unactuated position from the first actuated position, such impacts can be at least partially cushioned by the compliant nature of the damper 210. Moreover, as discussed above, the deformable nature of the damper 210 may allow the damper to at least partially slow the movement of the rotating components and/or absorb some of the impact forces.

Additionally, as shown in FIGS. 3A-4B, according to certain embodiments, the housing 202 can include a recess or groove 272 that can accommodate rotational displacement of the actuation body 254 and/or at least a portion of the biasing element 208. Optionally, according to certain embodiments, the ends 274*a*, 274*b* of the recess or groove 272 may be sized to limit the extent to which the actuation body 254 and/or the biasing element 208 can be rotatably displaced from the neutral, unactuated position.

Additionally, according to the illustrated embodiment in which the biasing element 208 is a torsion spring, in response to the assembly 200 being displaced from the neutral, unactuated position, at least a portion of the biasing element 208, including, but not limited to, the first and second ends 250*a*, 250*b* of the biasing element 208, can move generally inwardly in the direction of the central axis 246, which can lead to relative motion between the biasing element 208 and the housing 202. However, according to the illustrated embodiment, the impact of such relative motion, as well as the effect of the forces at which the biasing element 208 and/or actuation body 254 may strike components of the assembly 200 when returning to the neutral, unactuated position, have on the dimensional sizes of effected components of the assembly 200 may be relatively minimal.

Moreover, dimensional changes that may be affected by impact forces and relative motion of components of the assembly (including, for example, the shape and sizes of the biasing element 208, actuation body 254, and/or rib 270 of the housing 202) may be minimized and/or minimal in view of the compliant nature of the damper 210. The compliant nature of the damper 210 may also minimize and/or eliminate wear at such associated interfaces, as previously discussed. Further, to the extent such forces and motion do adversely impact the sizes and/or wear of such components, the compliant nature of the damper 210 can, at least to a certain extent, compensate for such changes in the assembly 200 while minimizing and/or preventing the associated degradation of the droop and/or rattle performance of the knob or lever 114, 126.

As is evident from the foregoing, the damper 210 may provide a cushion between the biasing element 208 and at least one of the handle 114, 126 and the housing 202. In certain embodiments, the biasing element 208 is engaged with the housing 202 via the damper 210, and is engaged with the handle 114, 126 via an actuation plate. In the illustrated embodiment, the biasing element 208 and the damper 210 are positioned on the outward-facing side of the housing 202. Additionally or alternatively, a damper and a biasing element may be positioned on the opposite, inward-facing side of the housing 202 such that the biasing element is engaged with the housing 202 via the damper. In such forms, the spindle plate 220 may serve a function analogous to that described above with reference to the actuation plate 206, such that the biasing element is engaged with the handle 114, 126 via the actuation plate 220 of the spindle 204.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law.

Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A door hardware apparatus, comprising: a housing including a first projection comprising a damper formed of a compliant material; an actuator rotatably mounted to the housing, the actuator comprising a second projection that is aligned with the first projection when the actuator is in a neutral position; and a torsion spring engaged between the first projection and the second projection such that the torsion spring biases the actuator toward the neutral position, wherein the torsion spring includes a first arm and a second arm, and wherein the first arm has a first arm unactuated position in which the first arm abuts the damper; and wherein, during rotation of the actuator in a first rotational direction from the neutral position toward a first rotated position, the damper maintains the first arm in the unactuated position such that the first arm remains in contact with the damper while the second arm remains in contact with the second protrusion.

2. The door hardware apparatus of claim 1, wherein, during return of the actuator from the first rotated position toward the neutral position, the damper absorbs an impact force between the second arm and the first protrusion.

3. The door hardware apparatus of claim 1, wherein, during rotation of the actuator from the neutral position in a second direction opposite the first direction, the second arm remains in contact with the damper while the first arm remains in contact with the second protrusion.

4. The door hardware apparatus of claim 1, wherein with the actuator in the neutral position, each of the first arm and the second arm is in simultaneous contact with each of the damper and the second protrusion.

5. The door hardware apparatus of claim 1, wherein the damper comprises an elastomeric material.

6. The door hardware apparatus of claim 1, wherein the housing comprises an arcuate recess that accommodates the second projection as the actuator rotates between the neutral position and the first rotated position.

7. The door hardware apparatus of claim 1, wherein, with the actuator in the neutral position, each of the first arm and the second arm is engaged with the housing via the damper.

8. The door hardware apparatus of claim 1, wherein the damper comprises a block of the compliant material.

9. An apparatus for a door lock chassis assembly, comprising:

a housing comprising a first projection;

an actuator rotatably mounted to the housing, the actuator comprising a second projection that is aligned with the first projection when the actuator is in a neutral position; and a torsion spring comprising a first arm and a second arm having a gap defined therebetween, wherein the first projection and the second projection are positioned in the gap; and wherein at least one of the first projection and the second projection comprises a damper formed of a compliant material; and wherein at least a portion of the damper is positioned within the gap.

10. The apparatus of claim 9, wherein with the actuator in the neutral position, each of the first arm and the second arm is in simultaneous contact with each of the first projection and the second projection.

11. The apparatus of claim 9, further comprising a spindle rotatably mounted to the housing, wherein the spindle comprises the actuator.

12. The apparatus of claim 9, wherein the first projection comprises the damper.

13. The apparatus of claim 9, wherein rotation of the actuator in a first rotational direction from the neutral position toward a first rotated position causes the first arm to remain in contact with the first projection while the second arm remains in contact with the second projection; and wherein the damper is configured to absorb an impact force as the actuator returns from the first rotated position to the neutral position.

14. The door hardware apparatus of claim 9, wherein at least one of the first arm or the second arm is operable to directly contact the compliant material.

15. A door hardware apparatus, comprising:

a housing comprising a first projection;

an actuator rotatably mounted to the housing, the actuator including a second projection that is aligned with the first projection when the actuator is in a neutral position;

a torsion spring biasing the actuator toward the neutral position, the torsion spring comprising:

a first arm positioned on a first side of the first projection and the second projection when the actuator is in the neutral position; and a second arm positioned on a second side of the first projection and the second projection when the actuator is in the neutral position; and a damper formed of a compliant material, wherein at least a portion of the damper is positioned between the first arm and the second arm when the actuator is in the neutral position;

wherein, during rotation of the actuator in a first rotational direction from the neutral position toward a first rotated position, the first arm remains in contact with the damper while the second arm remains in contact with the second protrusion; and wherein, during return of the actuator from the first rotated position toward the neutral position, the damper absorbs a force of impact between the first arm and at least one of the first protrusion or the second protrusion.

16. The door hardware apparatus of claim 15, wherein one of the first projection and the second projection comprises the damper.

17. The door hardware apparatus of claim 16, wherein the first projection comprises the damper.

18. The door hardware apparatus of claim 17, wherein, with the actuator in the neutral position, each of the first arm and the second arm is in simultaneous contact with the damper and the second protrusion.

19. The door hardware apparatus of claim 15, wherein the damper projects through an opening in the housing such that the damper is partially positioned on opposite sides of the housing.

20. The door hardware apparatus of claim 15, wherein, during rotation of the actuator in the first rotational direction from the neutral position toward the first rotated position, the second arm moves out of contact with the damper.

21. A door hardware apparatus, comprising:

a housing;

a damper mounted to the housing, wherein the damper is formed of a compliant material;

an actuator rotatably mounted to the housing, the actuator comprising an arm that is angularly aligned with the damper when the actuator is in a neutral position; and a torsion spring engaged between the damper and the arm such that the torsion spring biases the actuator toward the neutral position, wherein the torsion spring includes a first arm and a second arm; and wherein, during rotation of the actuator in a first rotational direction from the neutral position toward a first rotated position, the first arm remains engaged with the housing via the damper while the second arm remains engaged with the arm.

22. The door hardware apparatus of claim 21, wherein the damper has a fixed position relative to the housing.

23. The door hardware apparatus of claim 21, wherein the torsion spring is formed of a material different from the compliant material.

24. The door hardware apparatus of claim 21, wherein the damper comprises a block of the compliant material.

* * * * *